United States Patent [19]

Kaldenbaugh

[11] Patent Number: 4,948,267

[45] Date of Patent: Aug. 14, 1990

[54] PRODUCT DISPLAY STORAGE PACKAGE

[75] Inventor: Nicholas Kaldenbaugh, Charlestown, Mass.

[73] Assignee: Foot-Joy, Inc., Brockton, Mass.

[21] Appl. No.: 235,581

[22] Filed: Aug. 24, 1988

[51] Int. Cl.[5] ..... B65D 33/16

[52] U.S. Cl. ..... 383/63; 383/9; 383/20; 383/103; 206/278; 206/806

[58] Field of Search ..... 206/278, 806; 383/100, 383/103, 20, 63, 64, 9; 229/87

[56] References Cited

U.S. PATENT DOCUMENTS

| | | | |
|---|---|---|---|
| 2,491,929 | 12/1949 | Ochard | 383/20 |
| 2,788,121 | 4/1957 | Ayres | 206/806 |
| 2,983,087 | 5/1961 | Schofield | 206/806 |
| 3,122,807 | 3/1964 | Ausnit | 383/64 |
| 3,252,567 | 5/1966 | Baron et al. | 206/278 |
| 3,324,520 | 6/1967 | Ausnit | 383/64 |
| 3,546,327 | 9/1967 | Ruda | 383/103 |
| 4,742,914 | 5/1988 | Klein | 206/806 |

FOREIGN PATENT DOCUMENTS

| | | | |
|---|---|---|---|
| 566859 | 12/1958 | Canada | 206/278 |
| 2044218 | 10/1980 | United Kingdom | 383/9 |

*Primary Examiner*—David T. Fidei

*Attorney, Agent, or Firm*—Pennie & Edmonds

[57] ABSTRACT

A hangable flexible plastic pouch having a rectangular body with a reclosable side aperture. The pouch has a hanger hook arrangement and may have ventilation holes to accommodate a moisture-containing object such as a glove.

3 Claims, 3 Drawing Sheets

PRODUCT DISPLAY STORAGE PACKAGE

BACKGROUND OF THE INVENTION

Prior display and storage packages for products which have high moisture contents after use such as sports gloves, have been proposed (U.S. Pat. No. 4,061,170). Such prior packages as proposed would be relatively expensive to manufacture and would be cumbersome, bulky, and otherwise unacceptable. Other packages that are hangable for in-store display have been suggested (U.S. Pat. No. 4,290,467).

SUMMARY OF THE INVENTION

Broadly, the present invention comprises a plastic pouch formed of two opposing plastic panels attached along at least two (2) sides and preferably three (3) sides with the remaining side or sides closable using a readily openable and closable closure. The pouch is hangable and is therefore suitable for use as a display package at the point of sale. After sale and during the use of the product, it is capable of providing for storage between uses of the product.

It is a feature of the invention that it is lightweight, flexible and collapsible to approximately the same thickness as the product it contains.

It is also a feature that the pouch has ventilation holes to permit escape of moisture from the product after use.

DETAILED DESCRIPTION OF THE PREFERRED EMBODIMENT

Figure 1:
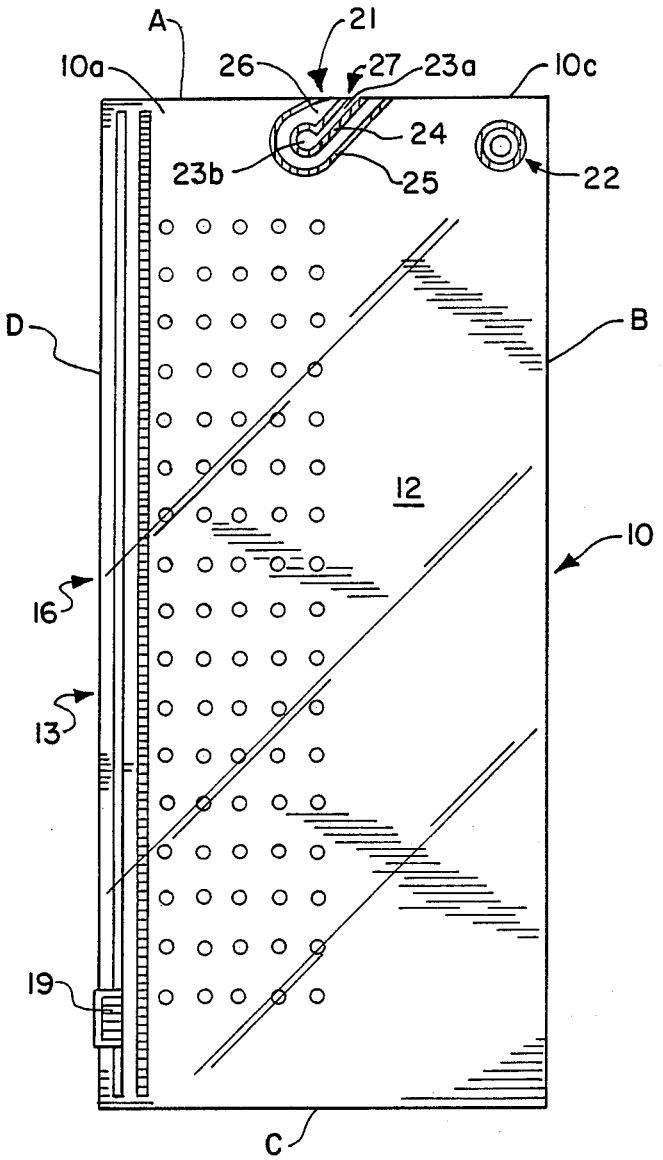
FIG. 1 is an elevational view of the pouch showing front panel.
Figure 2:
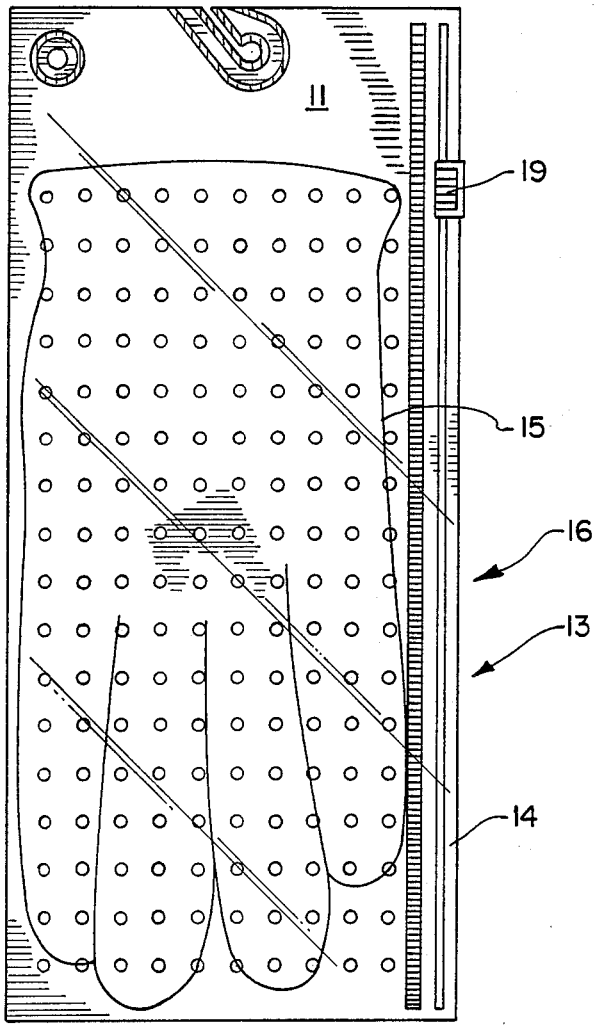
FIG. 2 is an elevational view showing the back of the pouch.
Figure 3:
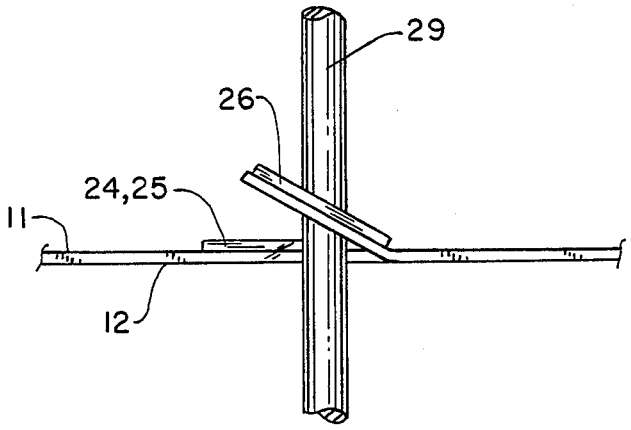
FIG. 3 is a partial top plan view of the pouch with a hook element being deflected for hanging.

In FIGS. 1–3, pouch 10 comprises relatively thin plastic back panel 11 and front panel 12 which panels are sealed together along three sides A, B, C, and D. Sealing can be accomplished along only two sides provided at least two adjacent sides are sealed. Any suitable means such as heat welding, crimping, or adhesive can be used to seal. Alternatively, the pouch 10 can be formed as a tube and thereafter the tube cut into segments with sealing of the remaining open sides being accomplished by any suitable means. Polyvinyl chloride material having a thickness of about 0.2 mm has been found suitable for plastic panels 11 and 12.

Unsealed pouch side D provides entrance opening 13 for insertion and removal of golf glove 15. This opening

13 has periphery border 14 comprising grooved rail 17 and raised rail 18 forming known closure unit 16.

Closure unit 16 and rails 17 and 18 are drawn together into engaging relationship by movable cam piece 19 and are separated by cam piece 19 as it moves in the opposite direction. Rails 17 and 18, as disengaged, re separated by hand and glove 15 is inserted into the pouch 10 (see FIG. 2). Other closures such as traditional metal zippers or snaps may be used.

The upper portion **10*a* of pouch 10 has center hanger 21 and corner hanger 22. Hanger 21 includes an angled keyhole opening 27 including channel opening 23*a* leading to the upper pouch edge 10*c* and generally round opening 23*b*. Keyhole opening 27 has border raised reinforcing 24 spaced from reinforcing 243 is outer reinforcing 25. Pouch projection 26 formed by the keyhole opening 27 is sufficiently rigid to support pouch 10 without turning or collapsing when the pouch 10 is hung on bar 29 (see FIG. 3). Pouch projection 26 is deflected as shown in FIG. 3 and pouch 10 is maneuvered to cause a bar 29 to move down channel slot opening 23*a* into round opening 23*b* and then projection 26 is centered to lie in the plane of the pouch panels 11 and 12. Pouch 10 will then depend with the surface of the rod 29 engaging curved surface 26*a* of projection 26. Corner hanger 22 consists of a reinforced border 22*a* and opening 22*b*** to receive hooks, rails and so forth for hanging on a golf bag clip, locker room nail, or other suitable place.

Pouch panels 11 and 12 include ventilation holes of a size and number to provide sufficient ventilation.

What is claimed:

1. A hangable flexible plastic pouch comprising a. a body having two rectangular opposing pouch panels of essentially the same shape and size forming four sides with two being longer and two being shorter;

b. securing means for securing the panels together along three (3) sides of which two are shorter sides and one is a longer side;

c. a closure means along the fourth longer side capable of being readily and repeatedly opened and closed;

d. ventilation holes in one of said panels; and e. hanger means formed in the body for hanging the pouch.

2. The plastic pouch of claim 1 in which the panels are large enough so that the pouch can accommodate a glove laying flat.

3. The plastic pouch of claim 1 in which the hanger means comprises a reinforced deflectable projection formed in a border portion of the pouch with an adjacent opening for receiving a hanger bar.

* * * * *